US010079463B2

(12) United States Patent
Fulton et al.

(10) Patent No.: US 10,079,463 B2
(45) Date of Patent: Sep. 18, 2018

(54) BRUSH WEAR INDICATOR

(71) Applicant: REMY TECHNOLOGIES, L.L.C., Pendleton, IN (US)

(72) Inventors: David Fulton, Anderson, IN (US); Andrew Dragon, Fishers, IN (US)

(73) Assignee: BORGWARNER INC., Auburn Hills, MI (US)

( * ) Notice: Subject to any disclaimer, the term of this patent is extended or adjusted under 35 U.S.C. 154(b) by 315 days.

(21) Appl. No.: 14/946,754

(22) Filed: Nov. 19, 2015

(65) Prior Publication Data

US 2017/0149189 A1 May 25, 2017

(51) Int. Cl.
*H01R 39/58* (2006.01)
*H01R 39/59* (2006.01)

(52) U.S. Cl.
CPC ..... *H01R 39/58* (2013.01); *H01R 39/59* (2013.01)

(58) Field of Classification Search
CPC ..... H01R 39/58; H01R 39/59
USPC ..... 310/242
See application file for complete search history.

(56) References Cited

U.S. PATENT DOCUMENTS 4,415,635 A * 11/1983 Wilsdorf ..... H01R 39/24 310/248
5,739,619 A * 4/1998 Thornley ..... H01R 39/58 310/245
6,933,650 B2 * 8/2005 Wang ..... H01R 39/58 310/239
2005/0110362 A1 * 5/2005 Yu ..... H01R 39/58 310/242
2009/0189479 A1 * 7/2009 Hockaday ..... H01R 39/415 310/244
2015/0076936 A1 * 3/2015 Osborne ..... H02K 13/10 310/50

FOREIGN PATENT DOCUMENTS

JP 05174935 A * 7/1993

* cited by examiner

*Primary Examiner* — Alex W Mok
(74) *Attorney, Agent, or Firm* — Cantor Colburn LLP

(57) ABSTRACT

An electric machine configured to increase resistance between a brush and a commutator of the electric machine at a wear condition of the brush consistent with end of service life.

6 Claims, 3 Drawing Sheets

BRUSH WEAR INDICATOR

BACKGROUND

Electric machines often use brushes to contact a rotating commutator and conduct electric power to a winding. Brushes are wear items in electric machines which employ them and generally function well until the brushes are worn beyond their service life. At the end of the service life of one or more brushes in a particular machine may fail to function. Because a machine that does not function impacts other operations, it is desirable to avoid a failure of the machine. Maintenance of wear items can certainly avoid failures but often the employment of a maintenance schedule entails the replacement of parts of the electric machine before its actual service life is over. In part this is because each electric machine and its unique environment of operation will have a distinct service life. Early replacement of parts or of the electric machine increases costs. Unfortunately heretofore there has been no mechanism or method to monitor the brushes actual life such that reliable replacement at an actual needed interval could be accomplished leaving the industry with scheduled maintenance (and inherent added cost) as the only option. The industry then would be receptive to reliable alternatives.

SUMMARY

An electric machine configured to increase resistance between a brush and a commutator of the electric machine at a wear condition of the brush consistent with end of service life.

A brush for an electric machine includes a brush body, an interrupter operable to cause a rise in resistance between the brush body and a commutator of an electric machine in which the brush is installed, when the brush is near an end of service life.

BRIEF DESCRIPTION OF DRAWINGS

The following descriptions should not be considered limiting in any way. With reference to the accompanying drawings, like elements are numbered alike.

DETAILED DESCRIPTION

Figure 1:
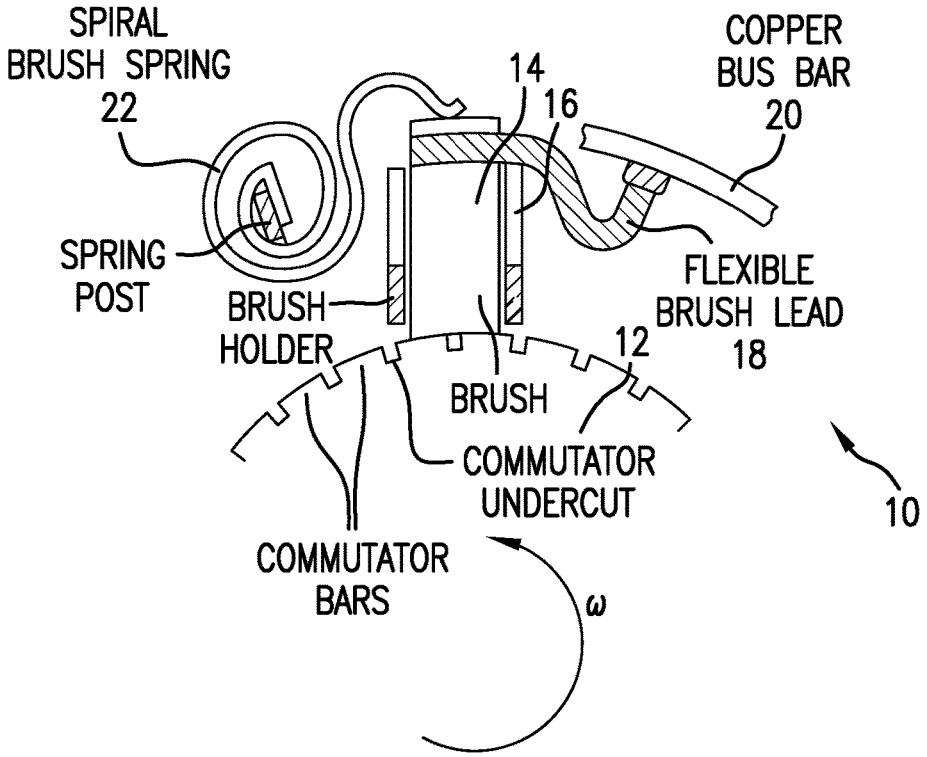
FIG. 1 PRIOR ART
FIG. 1 is a schematic cross sectional representation of a portion of a prior art electric machine.

Referring to FIG. 1, one of ordinary skill in the art will recognize a common arrangement of a brushed electric machine 10. A commutator 12, a brush 14, a brush holder 16, a lead 18, a bus bar 20, and a spiral spring 22 to urge the brush toward the commutator 12 are all shown and will be easily recognized.

Figure 2:
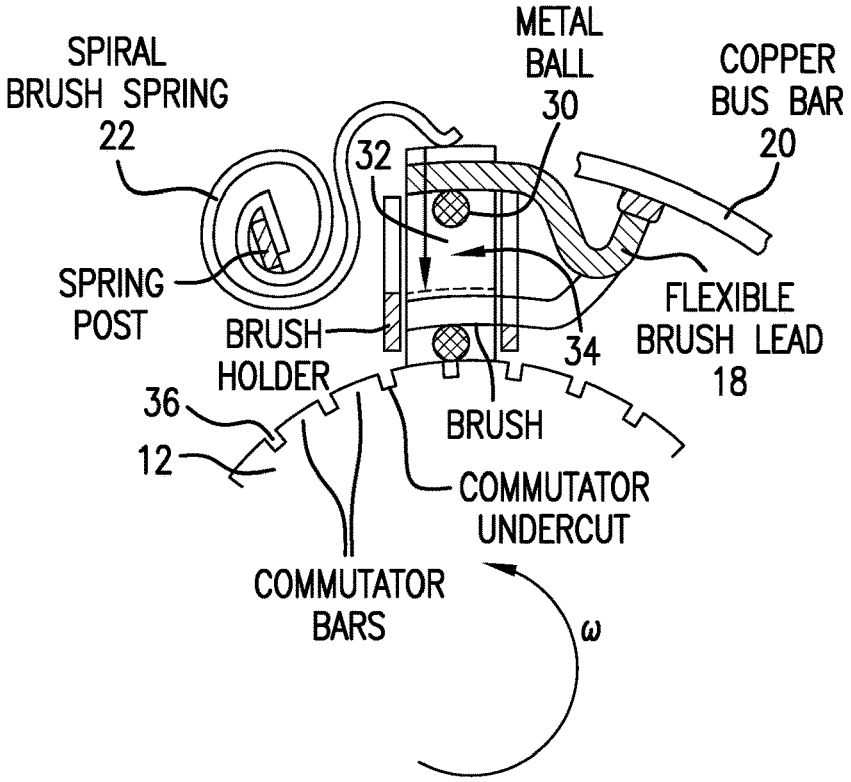
FIG. 2 is a schematic cross sectional view of the same portion of an electric machine modified as disclosed herein.
Figure 2:
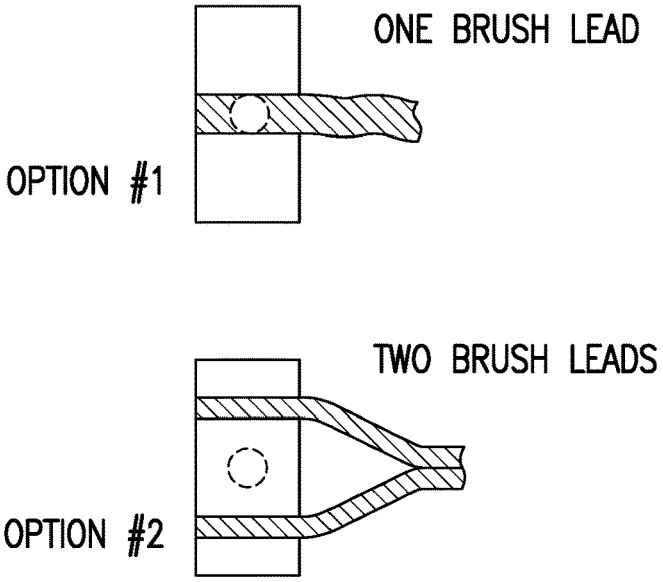

Referring to FIG. 2, distinctions between the illustration of FIG. 1 and the invention will become evident. In order to ensure that a worn brush may be indicated and discovered at an appropriate time to allow for replacement of the brush or the entire electric machine, as appropriate, at a time that is not unduly early (such as in scheduled maintenance) and does not significantly increase the chances of a failure of the machine (as in a wait and see approach), there is taught herein a configuration that will cause an increase in resistance between the commutator and the brush in which the configuration is included. The configuration may be included in one or more of the brushes. In one embodiment the positive brushes are provided with the configuration. In other embodiments all of the brushes may be so configured. The increase in resistance is at a magnitude that is detectable by a control system (not shown), such as an automotive ECU. By creating the resistance change, the controller is provided a signal that may then be distributed to an operator or a maintenance function that repair is needed. Because the resistance is higher rather than simply open, the machine will still function (at a reduced efficiency) instead of completely failing to function. Consequently, overall efficiency of the operation within which the electric machine is included is improved.

Still referring to FIG. 2, it is noted that the illustration shows the brush in two positions, one new and one worn to end of life. In one embodiment an interrupter 30 is made a part of a brush body 32 to form a brush 34, such as by positioning a ball, bead, or any other geometric shape of material into the brush body 32 while being formed or thereafter with suitable machining of the brush body in order to accept the interrupter 30. The interrupter 30 is of a more durable material than the material of the brush body 32 such that when wear of the brush 34 brings the interrupter 30 into contact with the commutator 12, including the commutator undercuts 36, the interrupter 30 will cause the brush 34 to bounce on the commutator 12.

To ensure a proper understanding of the functionality of the arrangement, it is noted that the wear of the brush body 32 at the time the interrupter 30 is brought into contact with the commutator 12 will be of the electrical rather than frictional variety. As will be appreciated by one of skill in the art, the degree of electrical wear of a brush in an electric machine is reduced with the force applied to the commutator through the brush. Because of the interrupter in the present disclosure, the force on the material of the brush body 32 material about the interrupter 30 becomes less due to the load being assumed by the interrupter 30. Resultantly, the lesser force on the brush body 32 creates an environment where electrical wear of the brush body material increases eroding the material around the interrupter 30 and leaving the interrupter proud of the surface of the brush body 32. This causes a gap to form between the commutator and the brush body thereby exacerbating both the rise in resistance and the electrical erosion of the brush body 32. With the increase in resistance, the voltage drop (from brush to commutator) will consequently increase. The resistance is not so great as to prevent the electric machine functioning at this point but the voltage drop is sufficient to be detected by a controller and can therefore be monitored. Also, in machines with 4 or 6 brushes, such as an electric starter motor, parallel circuits will still carry most of the motor current, even if one brush has worn enough to cause the interrupter to contact the commutator. As more of the interrupter 30 is exposed, it will also begin to cause the brush to bounce on the commutator each time the interrupter crosses an undercut 36 in the commutator (or more aptly each time an undercut 36 of the commutator passes beneath the brush 34 and contacts the interrupter 30. The bouncing serves to increase the gap between the brush and the commutator thus further increasing the resistance and voltage drop The positioning of the interrupter 30 in the brush body 32 will be such that the interrupter 30 does not become exposed to the commutator until near the end of service life for the brush 34. Accordingly, as noted above the resistance change is a signal that is readable by a controller, which then may alert a user by selected means that repair is needed. It is noted that in some embodiments the interrupter will have an electrical conductivity lower than the material of the brush to further punctuate the resistance change.

The signal discussed above may take the form of battery terminal voltage variation; current draw by the motor (starter in one embodiment) requiring a current sensor not shown but well known as a sensor itself, a pattern of variation in either voltage or current during cranking or overrun or start to start trends in voltage or current peaks. Each of the voltage changes can be measured directly by the ECU or other controller and each of the current based indications would use a current sensor that then supplies a signal to the ECU or other controller to detect patterns.

Figure 3:
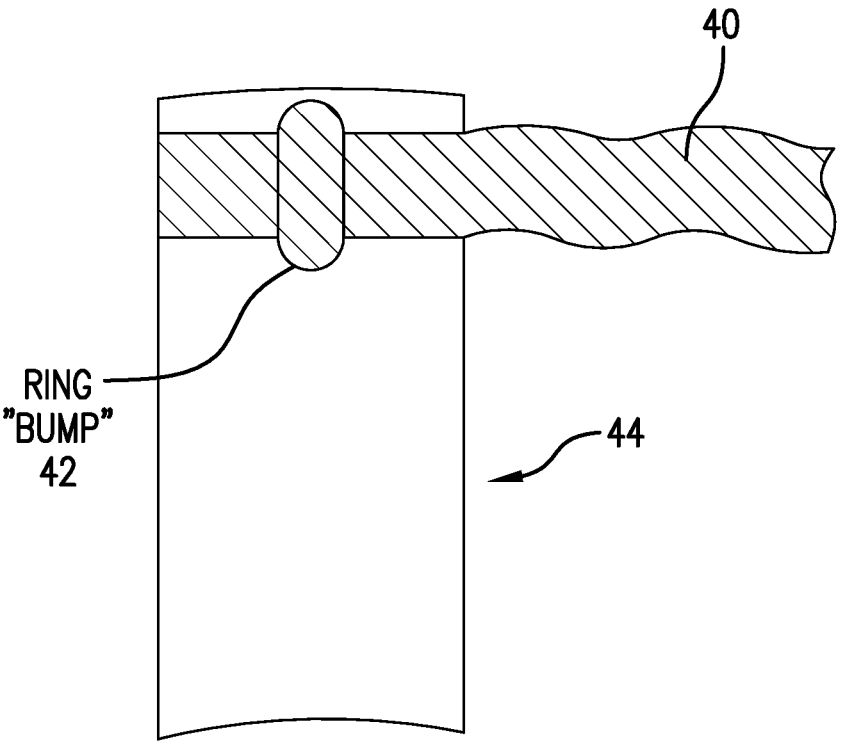
FIG. 3 is a schematic cross sectional view of an alternate brush configuration.
Figure 4:
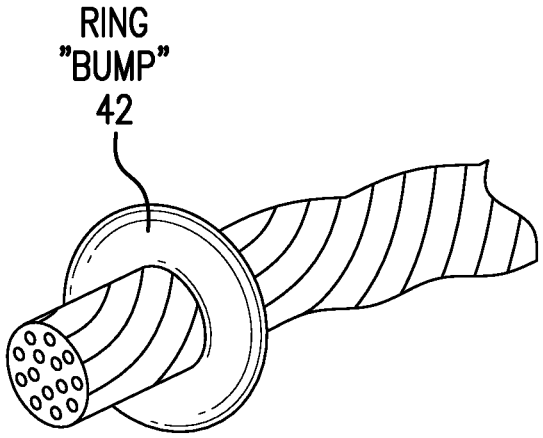
FIG. 4 is a perspective view of the lead in FIG. 3.

Referring to FIGS. 3 and 4, an alternate embodiment of the interrupter is illustrated. This embodiment works in the same manner as in FIG. 2 but it uses a configuration of lead 40 to provide the more durable material of an interrupter. More specifically, a body 42 is created in contact with the lead 40 that will be exposed to the commutator when the brush 44 is near end of life. The body may be a hardened piece of the stranded lead, and may be annular (shown) or part annular (any part of the illustrated annular body) or may simply be an appendage in the direction of the working end of the brush 44 such that the appendage will come into contact with the commutator before the lead in normal usage.

The invention claimed is:

1. An electric machine configured to increase resistance between a brush and a commutator of the electric machine at a wear condition of the brush consistent with end of service life, the brush including an at least part annular interrupter body attached to a lead.

2. The brush as claimed in claim 1 wherein the body is annular.

3. A brush for an electric machine comprising:

a brush body;

an interrupter operable to cause a rise in resistance between the brush body and a commutator of an electric machine in which the brush is installed, when the brush is near an end of service life and wherein the interrupter causes the brush to bounce on the commutator.

4. The brush as claimed in claim 3 wherein the bounce is caused by the interrupter striking undercuts of the commutator.

5. The brush as claimed in claim 3 wherein the interrupter is embedded in the brush body.

6. The brush as claimed in claim 3 wherein the interrupter is a ball.

* * * * *